US010150007B2

(12) United States Patent
Shinohara

(10) Patent No.: US 10,150,007 B2
(45) Date of Patent: Dec. 11, 2018

(54) COLORED GOLF BALL

(71) Applicant: BRIDGESTONE SPORTS CO., LTD., Tokyo (JP)

(72) Inventor: Hirotaka Shinohara, Chichibu (JP)

(73) Assignee: Bridgestone Sports Co., Ltd., Minato-ku, Tokyo (JP)

( * ) Notice: Subject to any disclaimer, the term of this patent is extended or adjusted under 35 U.S.C. 154(b) by 0 days.

(21) Appl. No.: 15/830,755

(22) Filed: Dec. 4, 2017

(65) Prior Publication Data

US 2018/0178073 A1 Jun. 28, 2018

(30) Foreign Application Priority Data

Dec. 26, 2016 (JP) ..... 2016-251084

(51) Int. Cl.
*A63B 37/00* (2006.01)
*A63B 37/14* (2006.01)

(52) U.S. Cl.
CPC ..... *A63B 37/0022* (2013.01); *A63B 37/0023* (2013.01); *A63B 37/0074* (2013.01)

(58) Field of Classification Search
CPC ..... A63B 37/0022; A63B 37/0023; A63B 37/0003
See application file for complete search history.

(56) References Cited

U.S. PATENT DOCUMENTS

2004/0097302 A1* 5/2004 Isogawa ..... A63B 37/0003 473/378
2009/0054176 A1* 2/2009 Isogawa ..... A63B 37/0022 473/378
2009/0118039 A1* 5/2009 Shinohara ..... A63B 37/0031 473/373
2013/0053186 A1* 2/2013 Tachibana ..... A63B 37/0004 473/384

FOREIGN PATENT DOCUMENTS

JP 2004-081350 * 3/2004 ..... A63B 37/0022
JP 2009-045347 A 3/2009

* cited by examiner

*Primary Examiner* — John E Simms, Jr.
(74) *Attorney, Agent, or Firm* — Sughrue Mion, PLLC

(57) ABSTRACT

A colored golf ball has improved luxurious appearance without impairing its visibility. The colored golf ball of the present invention includes a core; a cover placed around the core having dimples formed on its surface; and a coating layer placed on top of the cover, in which the coating layer includes a polymer matrix having a bright material dispersed therein, and an $L_0$ value, which represents an L value in the Lab color system of the colored golf ball before being covered with the coating layer, is 25 or less, and the difference $\Delta L$ between the $L_0$ value and an $L_1$ value, which represents an L value in the Lab color system of the colored golf ball after being covered with the coating layer, is 5 or more.

4 Claims, 9 Drawing Sheets
(8 of 9 Drawing Sheet(s) Filed in Color)

COLORED GOLF BALL

CROSS-REFERENCE TO RELATED APPLICATION

This Application claims priority from Japanese Patent Application No. 2016-251084 filed Dec. 26, 2016, which is incorporated herein by reference in its entirety.

BACKGROUND OF THE INVENTION

The present invention relates to a colored golf ball.

In general, golf balls are white in appearance. In manufacturing a white golf ball, generally, a white pigment is mixed in a resin of a cover having dimples formed thereon, and a colorless and transparent top coat is formed on the surface of the cover. Sometimes, a bright material is dispersed in the top coat to produce a golf ball having a white pearl tone appearance.

Although a white golf ball provides excellent visibility, a white ball has a problem in that it cannot be easily distinguished from golf balls of other golfers. In view of this problem, balls colored red, blue or other colors are commercially sold, but golfers tend not to use these balls. One reason may be that such colored golf balls lack a luxurious appearance.

JP 2009-045347 A discloses a golf ball that ensures a luxurious appearance without giving golfers any unfamiliar impressions, while providing excellent visibility and distinguishability by using a fluorescent colorant, instead of a titanium oxide which is used as a white colorant, and a polarizing material of composite particles having nuclei of such material as mica coated with a titanium oxide as dispersed in a paint layer over the cover.

SUMMARY OF THE INVENTION

In general, in order to obtain a luxurious appearance, dark colors such as black are preferred, as seen in automobiles or lacquerware. If applied to golf balls, however, dark colored golf balls have a problem of remarkably poor visibility during a golf game.

It is therefore an object of the present invention to provide a colored golf ball which has a luxurious appearance without impairing its visibility.

To achieve the above-described object, a golf ball of the present invention includes: a core; a cover placed around the core and having dimples formed on its surface; and a coating layer placed on top of the cover and having a bright material dispersed therein. In the golf ball of the present invention, $L_0$ value, which represents an L (lightness) value in the Lab color system of the colored golf ball before being covered with the coating layer (hereinafter referred to as "$L_0$ value"), is 25 or less, and the difference $\Delta L$ between $L_0$ value and $L_1$ value, which represents an L value in the Lab color system of the colored golf ball after being covered with the coating layer (hereinafter referred to as "$L_1$ value"), is 5 or more.

The cover may contain a colorant, so that an $L_0$ value of 25 or less is obtained. Further, in order to obtain an $L_0$ value of 25 or less, a paint layer containing the colorant may be disposed between the coating layer and the cover. Furthermore, in order to obtain an $L_0$ value of 25 or less, an intermediate layer containing the colorant may be disposed between the core and the cover while the cover is made colorless and transparent. Alternatively, a two-piece golf ball, having a core and a colorless and transparent cover, may contain a colorant in the core. The $L_0$ value may be 20 or less.

The $L_1$ value may be 20 or more, or 25 or more, as long as the difference $\Delta L$ is 5 or more. The $L_1$ value is preferably 30 or more, more preferably 40 or more, and still more preferably 50 or more.

In the coating layer, it is preferred that the bright material be dispersed in a colorless and transparent polymer matrix.

According to the present invention, even if the golf ball has a very dark color having an $L_0$ value of 25 or less, the bright material is dispersed in the coating layer such that the difference $\Delta L$ between the $L_0$ value and $L_1$ value is increased by 5 or more. If so, although the golf ball has a low lightness as a whole, it can provide an improved luxurious appearance without impairing its visibility due to higher polarization property available from the bright material.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE PREFERRED EMBODIMENT

An embodiment of a colored golf ball according to the present invention will now be described in detail with reference to the accompanying drawings.

Figure 1:
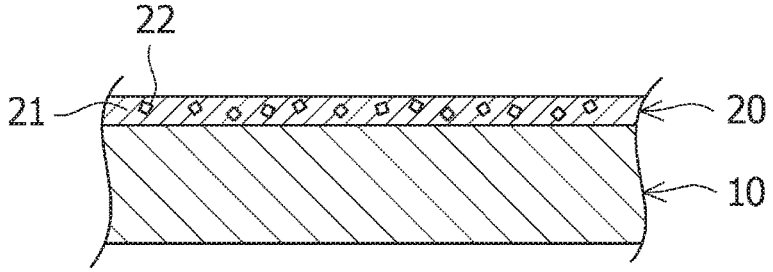
FIG. 1 is a sectional view schematically illustrating the surface of a colored golf ball according to an embodiment of the present invention.

The colored golf ball of this embodiment, as shown in FIG. 1, mainly comprises a core (not shown), a cover 10 placed around the core and having dimples (not shown) formed on its surface, and a coating layer 20 placed on top of the cover and including a polymer matrix 21 in which a bright material 22 is dispersed. The coating layer 20 may be an outermost surface of the golf ball, or may be further provided with a top coat (not shown) thereon. The colored golf ball of the present invention may have a multi-piece structure such as a three-piece structure comprising an intermediate layer between the core and the cover, as well as a two-piece structure having the core and the cover.

The core can be formed mainly of a base rubber. As the base rubber, a variety of rubbers may be used, such as polybutadiene rubber (BR), styrene-butadiene rubber (SBR), natural rubber (NR), polyisoprene rubber (IR), polyurethane rubber (PU), silicon rubber, although it is not limited thereto.

As well as the base rubber for the main component, for example, co-crosslinking agent, crosslinking agent, filler, age resistor, isomerization agent, peptizing agent, sulfur and organic sulfur compound may be optionally added to the core. As the main component, thermoplastic elastomer, ionomer resin or a mixture of these components may be used instead of the base rubber.

The core may be solid or hollow, and is substantially spherical. The outer diameter of the core is preferably in a range of 5 to 42 mm, and more preferably in a range of 25 to 40 mm, although it varies depending on whether the intermediate layer is disposed or not. It is permissible to provide an intermediate layer which functions as a core or a cover if the intermediate layer is disposed. As the method of forming the core, any known method of forming the core for a golf ball may be adopted.

The cover 10 is formed using a resin composition for the cover. The resin composition for the cover comprises a resin for the cover as the main component and further contains a colorant. Owning to this, the $L_0$ value can be 25 or less, which shows very dark color. The $L_0$ value is more preferably 20 or less. The lower limit of the $L_0$ value is not restricted to any particular values, but is preferably 5 or more.

As the colorant to obtain an $L_0$ value of 25 or less, it is preferable to use an achromatic colorant such as black or grey colorant. Specifically, carbon black, etc. can be used as the black colorant, while titanium oxide/carbon black, etc. can be used as the grey colorant. Any one of these colorants may be used alone or two or more may be used together. The composition ratio of the colorant in the resin composition for the cover is set as appropriate depending on the $L_0$ value or the kind of the colorant.

As the covering resin, ionomer resin, polyurethane thermoplastic elastomer, thermosetting polyurethane or a mixture of these substances, may be used as the main component to form the cover, although not limited thereto. Furthermore, as well as the aforementioned main component, other thermoplastic elastomer, polyisocyanate compound, fatty acid or its derivative, basic inorganic metal compound or filler may be added to the cover.

As the method of forming the cover 10, any known method of forming the cover for a golf ball may be adopted. For example, the cover may be formed by disposing a core in a mold and injection-molding the resin composition for the cover into the mold such that the cover is placed on top of the core, although the method is not restricted to any particular one. The mold for forming the cover has plural protrusions to form dimples on the surface of the cover. Regarding the thickness of the cover, its lower limit is preferably 0.2 mm or more, and more preferably 0.4 mm or more, and its upper limit is preferably 4 mm or less, more preferably 3 mm or less, and still more preferably 2 mm or less, although it is not limited thereto.

The cover 10 does not need to have an $L_0$ value of 25 or less as a whole, but only needs to have such a value in 50% or more, preferably 70% or more, and more preferably 90% or more thereof so as to provide the golf ball of the present invention having a particular color tone.

In the above embodiment, explanations are given of adding the colorant to the cover to obtain an $L_0$ value of 25 of less. However, the present invention is not restricted thereto. For example, a paint layer may be disposed between the cover and the coating layer so as to ensure an $L_0$ value of 25 or less. In this case, the abovementioned colorant may be used for the paint layer. The thickness of the paint layer is preferably 3 to 30 μm, and more preferably 5 to 20 μm. As an alternative example, the colorant may be added to the intermediate layer disposed between the cover and the core, or the colorant may be added to the core while making the cover colorless and transparent, so that the $L_0$ value can be 25 or less.

The coating layer 20 is formed using a polymer composition for the coating layer. The polymer composition for the coating layer has a polymer for the coating layer as a matrix component, in which the bright material 22 is dispersed in the matrix component. Owning to the coating layer 20 having the polymer matrix 21 in which the bright material 22 is dispersed, the $L_1$ value can be higher than the $L_0$ value by 5 or more (i.e., $L_1-L_0=\Delta L\geq 5$). As a result, although the golf ball has a low lightness as a whole, it can provide an improved luxurious appearance without impairing its visibility due to higher polarization property provided by the bright material. The polymer matrix 21 is preferably colorless and transparent.

Figure 2A:
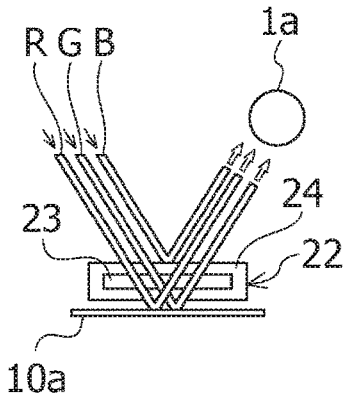
FIGS. 2A to 2C are schematic views illustrating the reflection of incident light on the surface of the colored golf ball according to the present invention.

For example, as shown in FIG. 2A, if the cover 10*a* has a general white color having an L value of approximately 90 in the Lab color system, blue light (of red (R), green (G), and blue (B) that are the three primary colors of light) in the incident light is reflected by the bright material 22 dispersed in the coating layer, whereas red and green light penetrates through the bright material 22. Then, red and green light that has penetrated through the bright material 22 is reflected by the white cover 10*a* to again penetrate through the bright material 22. Since the golf ball 1*a* has the white cover 10*a* covered with the coating layer in which the bright material 22 is dispersed, it has a white appearance. The bright material 22 generally comprises flake particles that cover a nucleus 23 formed of mica, silica, alumina and the like with a covering layer 24 formed of metal oxide such as titanium dioxide. The bright material is also called a pearlescent pigment. The reflectivity and penetrability of the three primary colors of light vary depending on the material or structure of the bright material. Although the reflection by the bright material 22 is a composite one of the reflection by the covering layer 24 and the reflection by the core 23, FIGS. 2A to 2C simply show the reflection by the bright material 22.

Figure 2B:
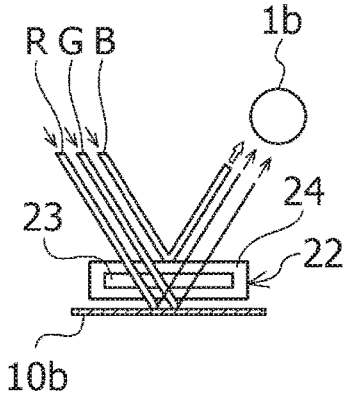
Figure 2C:
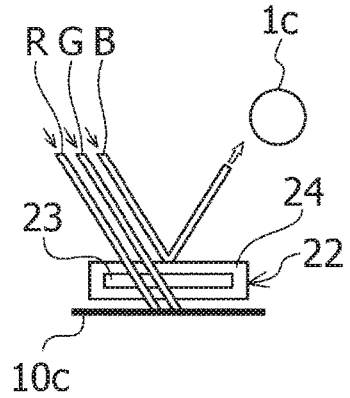

On the other hand, as shown in FIG. 2B, if the cover 10*b* has a dark grey color having an L value of 25 or less in the Lab color system, red and green incident light of the incident light, which has penetrated through the bright material 22, is only partially reflected by the cover 10*b*. Thus, the golf ball 1*b*, having the dark grey cover 10*b* covered with the coating layer in which the bright material 22 is dispersed, provides a luminous bluish white shine in dark grey as background. Furthermore, as shown in FIG. 2C, if the cover 10*c* has a black color having an L value of 20 or less in the Lab color system, red and green incident light of the incident light, which has penetrated through the bright material 22, is hardly reflected by the cover 10*c*. Thus, the golf ball 1*c*, having the black cover 10*c* covered with the coating layer in which the bright material 22 is dispersed, provides a luminous blue shine in black background.

The value of ΔL is preferably 10 or more, more preferably 15 or more, still more preferably 20 or more, particularly preferably 25 or more, and most preferably 30 or more, although this is not necessarily restricted to these values since the value of ΔL depends on the $L_0$ value. The $L_1$ value may be, for example, 20 or more, or 25 or more, or is preferably 30 or more, more preferably 40 or more, and still more preferably 50 or more, although this is not necessarily restricted to these values since the $L_1$ value largely depends on the $L_0$ value. The upper limit of the $L_1$ value is preferably 60 or less, although not limited thereto.

As the bright material 22 that is dispersed in the polymer composition for the coating layer, a variety of materials are commercially available. For example, "Iriodin" (registered trademark), "Pyrisma" (registered trademark), "Miraval" (registered trademark), "Colorstream" (registered trademark), and "Xirallic" (registered trademark) are available from Merck Japan. Iriodin is a powder-type inorganic pearlescent pigment in which the surface of a natural mica is coated with metal oxide having a high refractive index such as titanium oxide and iron oxide. Pyrisma is an effect pigment having a high chroma in which mica particles are coated with titanium oxide. Miraval comprises a borosilicate glass as a base material. Colorstream is a pigment comprising a silica flake as a base material, the silica flake being coated with metal oxide such as titanium oxide or iron oxide. Xirallic is a pigment having a high brightness in which an artificially-synthesized alumina flake is coated with metal oxide. Xirallic exhibits a brighter character compared to Iriodin, and does not show a creamy color that is derived from trace impurities such as mica pearl.

The particle diameter of the bright material 22 is, for example, preferably 50 μm or less, and more preferably 30 μm or less, in terms of coating productivity. The lower limit of the particle diameter of the bright material 22 is preferably 5 μm or more, and more preferably 10 μm or more, although this is not limited thereto. The particle diameter is a number average particle diameter measured by "LA-910", a laser scattering particle size distribution analyzer, manufactured by Horiba, Ltd.

The polymer for the coating layer includes, but is not limited to, polymers such as two-liquid type curable polyurethanes including polyols such as acrylic polyols and polyester polyols as the base polymer, and isocyanates such as hexamethylene diisocyanate (HDI), tolylene diisocyanate (TDI), isophorone diisocyanate (IPDI), diphenylmethane diisocyanate (MDI), and the like as the curing agent. In addition to the above components, the base polymer may include solvents such as ethyl acetate, butyl acetate, propylene glycolmonomethyl ether acetate, methyl ethyl ketone, and methyl isobutyl ketone. In addition, the base polymer may include a curing catalyst to promote curing. However, the polymer composition, preferably, does not include a colorant such that the polymer matrix 21 is made colorless and transparent.

In the coating layer 20, the content of the bright material 22 per 100 parts by weight of the polymer for the coating layer is, for example, preferably 2 to 40 parts by weight, although this varies depending on the kinds of the bright material or the polymer. Even if the golf ball has a dark color having an $L_0$ value of 25 or less, the golf ball can provide an excellent bright appearance since 2 parts by weight or more of the bright material 22 is dispersed in the coating layer 20. The content of the bright material 22 is more preferably 3 parts by weight or more, and still more preferably 5 parts by weight or more. The greater the content of the bright material 22, the greater the value of ΔL (the difference between L values before and after being coated with the coating layer) becomes, which shows a preferable result. However, if the content of the bright material 22 exceeds a certain limit, its effect is saturated and the ability to mask the lower layer becomes too high. Accordingly, the content of the bright material 22 is preferably 40 parts by weight or less, and more preferably 35 parts by weight or less, and still more preferably 30 parts by weight or less.

To form the coating layer 20, any known coating method for a golf ball may be used. In general, the coating layer is formed by applying its polymer composition to the outer periphery of the cover 10. Regarding the thickness of the coating layer, its lower limit is preferably 3 μm or more, more preferably 5 μm or more, and still more preferably 10 μm or more, and its upper limit is preferably 100 μm or less, and more preferably 60 μm or less, although it is not limited thereto.

EXAMPLE

Next, examples of the present invention and comparative examples will be described below.

A coating layer for golf balls was formed by using various kinds of bright material. A color tone test for the golf balls before and after being coated with the coating layer was performed. Then, the luxurious appearance and visibility of the golf balls after being coated with the coating layer were evaluated. The results are shown in Tables 1 and 2 and FIGS. 3 to 12. Regarding a cover, titanium oxide was used as a covering resin, with the addition of titanium oxide as a white colorant, carbon black as a black colorant, and the mixture of titanium oxide and carbon black as a grey colorant. Regarding the coating layer, a two-liquid type curable polyurethane resin was used as a polymer for the coating layer. Each bright material in the Tables was added to the coating layer with the parts-by-weight ratio in the Tables. Iriodin 6123, Iriodin 6103, Iriodin 7215, Iriodin 7205, Pyrisma T40-24, Xirallic NXT M260-30SW, and Xirallic NXT T260-23SW in the Tables are bright materials that are commercially available from Merck Japan. The color of the bright material refers to a color tone recognized with the naked eye. The polymer matrix in the coating layer was made colorless and transparent. The thickness of the coating layer was made 15 μm for all cases.

(1) Color Tone Test

The color tone test was performed by using a color difference meter (spectrum measuring apparatus "SC-P", a product of Suga Test Instruments Co., Ltd.) in conformity with JIS Z 8722 "Reflective Object Measurement Methods" (illumination with diffused light, an optical system in which the received light angle is 8°: Condition c), and the color tone was measured by d/8 (measured excluding a regular reflection component of the sample: with an optical trap). The diameter of the measurement hole was 30 mm. Moreover, according to Lab color system under JIS Z 8701, values for L, a, and b were measured.

(2) Evaluation of Luxurious Appearance and Visibility

The evaluation of luxurious appearance was performed by observing the golf ball appearance with the naked eye. For the evaluation criteria for the luxurious appearance, the questionnaire was performed on 50 ordinary golfers. The result was evaluated as "Very good" when 45 or more golfers answered "the golf ball has luxurious appearance", "Good" when 30 to 44 golfers answered in that way, "Poor" when 6 to 20 golfers answered in that way, and "Bad" when 5 or fewer golfers answered in that way. The evaluation of visibility was performed by observing the golf ball appearance with the naked eye. For the evaluation criteria for the visibility, 50 ordinary golfers observed the golf ball with the naked eye at a distance of 30 yards from the golf ball in an ordinary golf course. The result was evaluated as "Very Good" when 40 or more golfers answered "the golf ball is easy to see on the grass", "Good" when 25 to 39 golfers answered in that way, "Poor" when 10 to 24 golfers answered in that way, and "Bad" when 9 or fewer golfers answered in that way.

7 (i.e., E1 to E7 in tables 1 and 2), a black colorant was added to the cover so that the cover had an $L_0$ value of 20 or less. In Examples 1 to 7, although the same amount of the same bright material as in Comparative Examples 1 to 5 was used, the golf ball provided a completely different appearance compared to the golf ball in Comparative Examples 1 to 7. The golf ball in Examples 1 to 5, although having an $L_1$ value of approximately 24 to approximately 54, which is still dark, provided a sufficiently luxurious appearance without any problems of visibility due to strong expression of the color tone of the bright material.

In Comparative Example 8 (i.e., C8 in table 2), a black cover was coated with a coating layer containing no bright material therein. The golf ball did not provide any visibility since it was completely black in color. In Comparative

TABLE 1

Figure 3A:
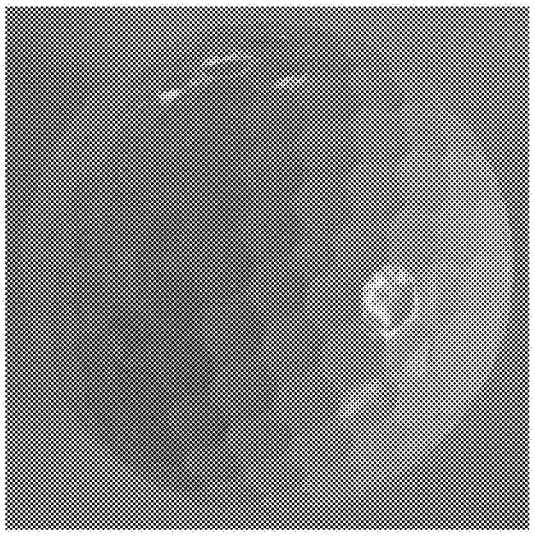
FIGS. 3A and 3B are photographs showing an appearance of one example of a golf ball according to the present invention and that of one comparative example.
Figure 3B:
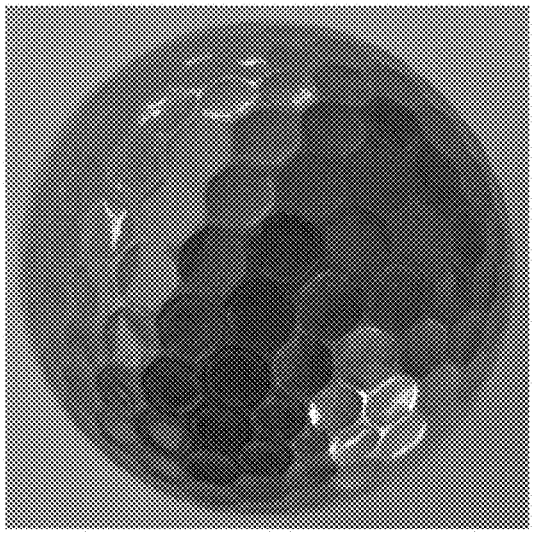
Figure 4A:
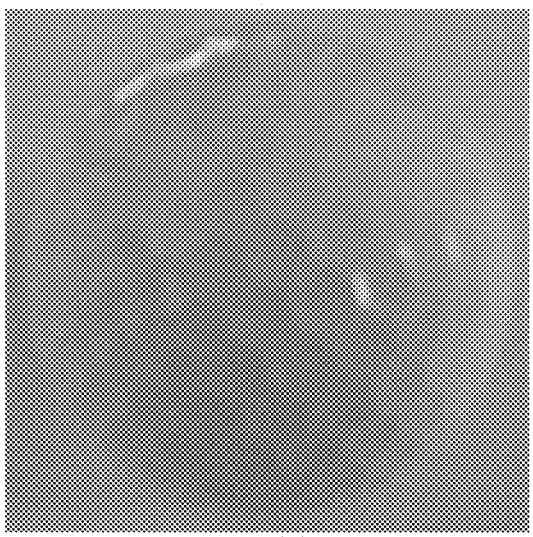
FIGS. 4A and 4B are photographs showing an appearance of one example of the golf ball according to the present invention and that of one comparative example.
Figure 4B:
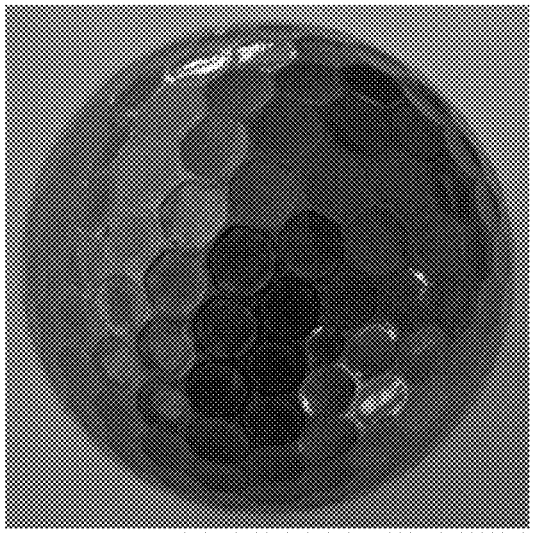
Figure 5A:
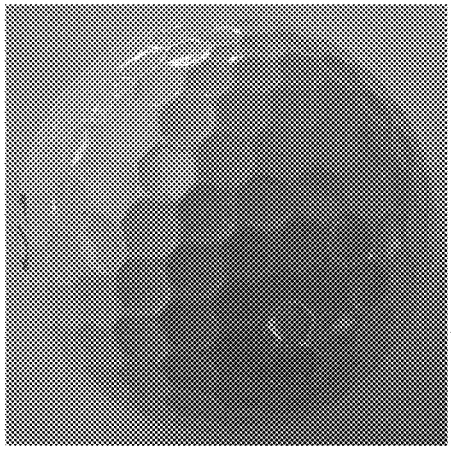
FIGS. 5A to 5D are photographs showing an appearance of one example of the golf ball according to the present invention and that of one comparative example.
Figure 5B:
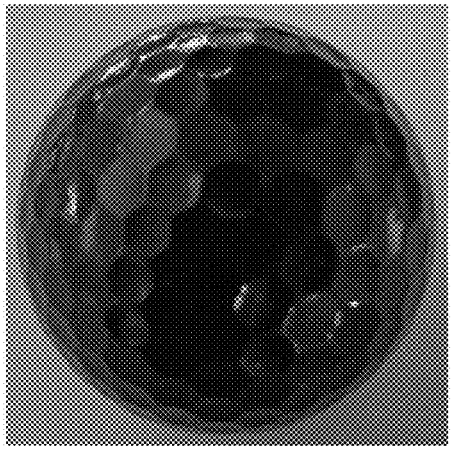
Figure 5C:
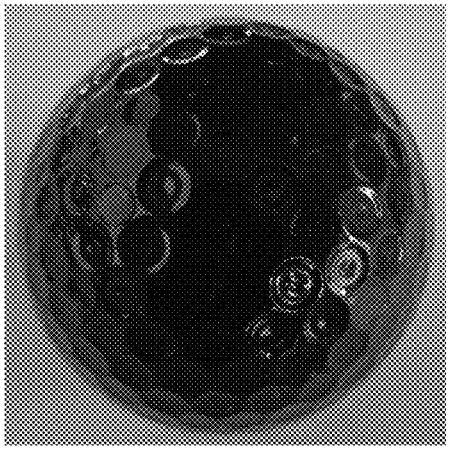
Figure 5D:
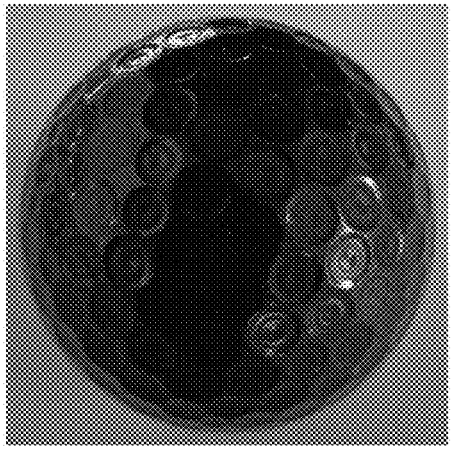
Figure 6A:
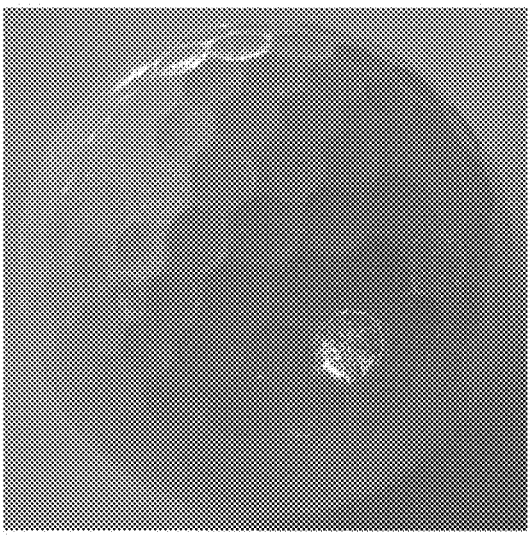
FIGS. 6A and 6B are photographs showing an appearance of one example of the golf ball according to the present invention and that of one comparative example.
Figure 6B:
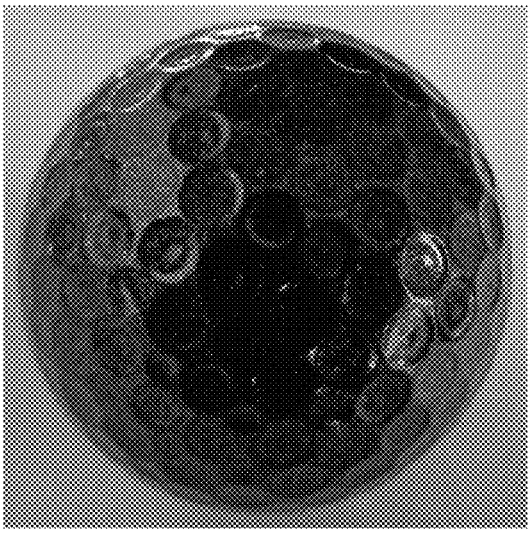

| | | C1 | E1 | C2 | E2 | C3 | E3 | E4 | E5 | C4 | E6 |
|---|---|---|---|---|---|---|---|---|---|---|---|
| Values in Lab color system before coating | $L_0$ | 89.06 | 19.29 | 89.06 | 19.29 | 89.06 | 19.29 | 19.29 | 19.29 | 89.06 | 19.29 |
| | $a_0$ | −0.47 | 0.12 | −0.47 | 0.12 | −0.47 | 0.12 | 0.12 | 0.12 | −0.47 | 0.12 |
| | $b_0$ | −11.87 | −0.6 | −11.87 | −0.6 | −11.87 | −0.6 | −0.6 | −0.6 | −11.87 | −0.6 |
| | Color (with naked eye) | White | Black | White | Black | White | Black | Black | Black | White | Black |
| Ratio in the coating layer | Resin | 35 | 35 | 35 | 35 | 35 | 35 | 35 | 35 | 35 | 35 |
| | Bright material | 6 | 6 | 6 | 6 | 6 | 6 | 2 | 10 | 6 | 6 |
| Bright material | Kind | Iriodin 6123 | | Iriodin 6103 | | Xirallic NXT T260-23 SW | | | | Iriodin 7215 | |
| | Color | Grey | | Charcoal | | Blue | | | | Red | |
| Values in Lab color system after coating | $L_1$ | 89.43 | 53.05 | 89.43 | 40.63 | 88.6 | 32.03 | 24.86 | 32.47 | 88.2 | 24.54 |
| | $a_1$ | 0.22 | −1.1 | 0.22 | 0.59 | −0.68 | 3.74 | 2.02 | 3.78 | −1.99 | 8.28 |
| | $b_1$ | −8.26 | −8.33 | −8.26 | −7.54 | −8.09 | −35.79 | −16.1 | −37.28 | 0.34 | −2.54 |
| $L_1 - L_0$ ( Δ ) | | 0.37 | 33.76 | 0.37 | 21.34 | −0.46 | 12.74 | 5.57 | 13.18 | −0.86 | 5.25 |
| Luxurious appearance | | Poor | Poor | Poor | Very good | Poor | Very good | Very good | Very good | Poor | Very good |
| Visibility | | Very good | Good | Very good | Good | Very good | Good | Good | Good | Very good | Good |
| Photograph | | FIG. 3A | FIG. 3B | FIG. 4A | FIG. 4B | FIG. 5A | FIG. 5B | FIG. 5C | FIG. 5D | FIG. 6A | FIG. 6B |

TABLE 2

Figure 7A:
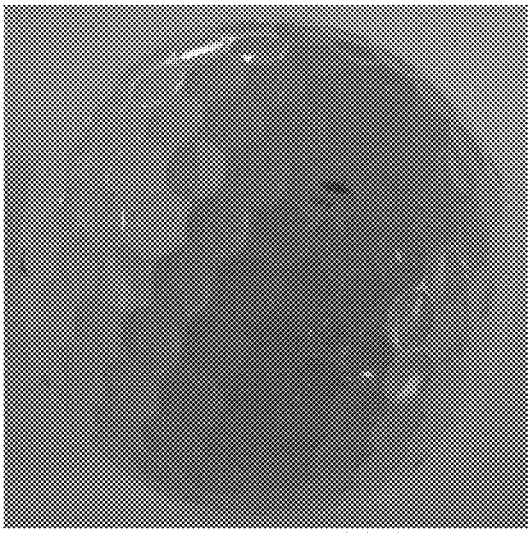
FIGS. 7A and 7B are photographs showing an appearance of one example of the golf ball according to the present invention and that of one comparative example.
Figure 7B:
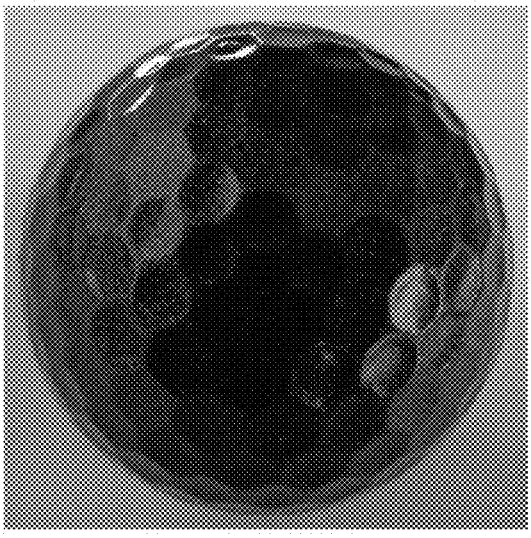
Figure 8A:
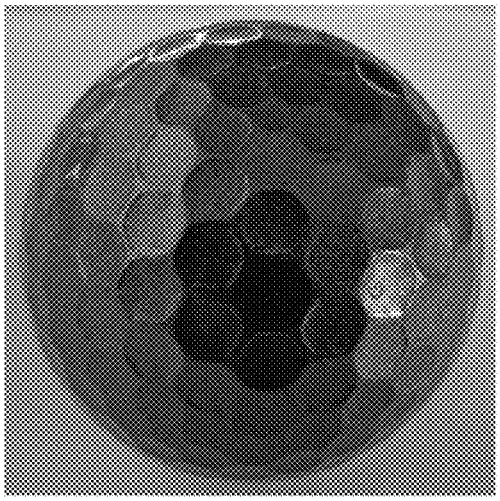
FIGS. 8A to 8C are photographs showing an appearance of one example of the golf ball according to the present invention and that of one comparative example.
Figure 8B:
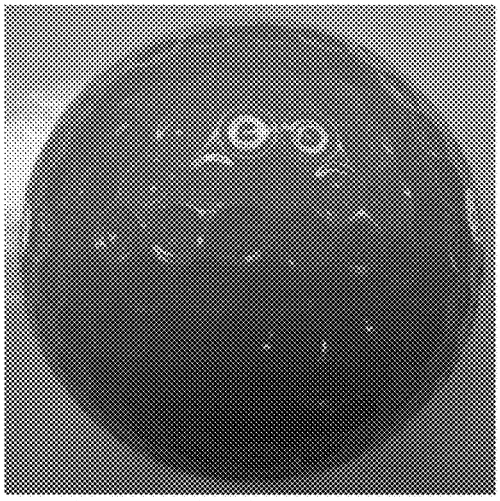
Figure 8C:
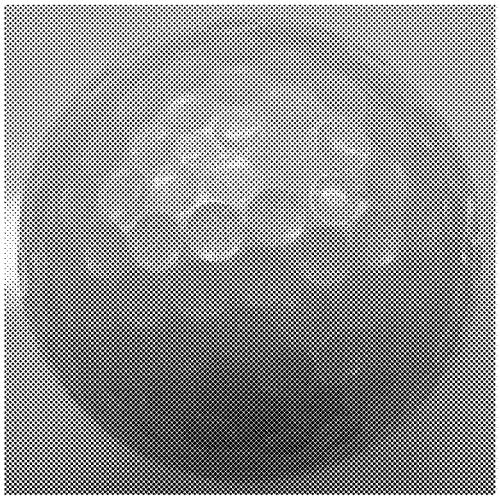
Figure 9:
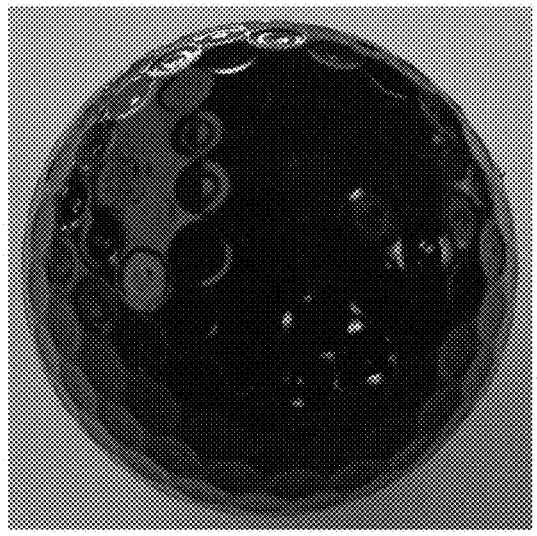
FIG. 9 is a photograph showing an appearance of one comparative example of a golf ball with respect to the present invention.
Figure 10:
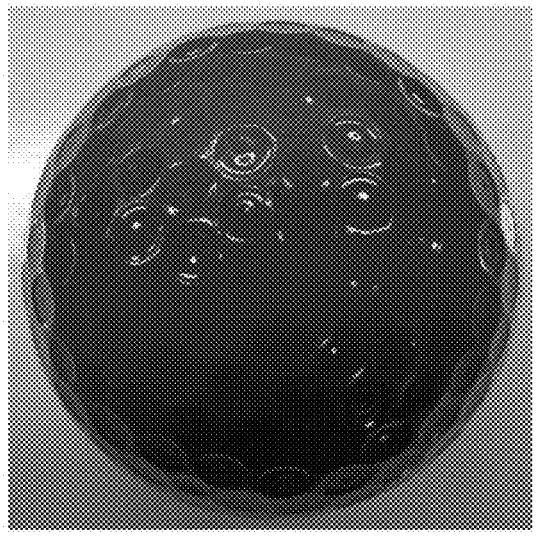
FIG. 10 is photograph showing an appearance of one comparative example of the golf ball with respect to the present invention.
Figure 11:
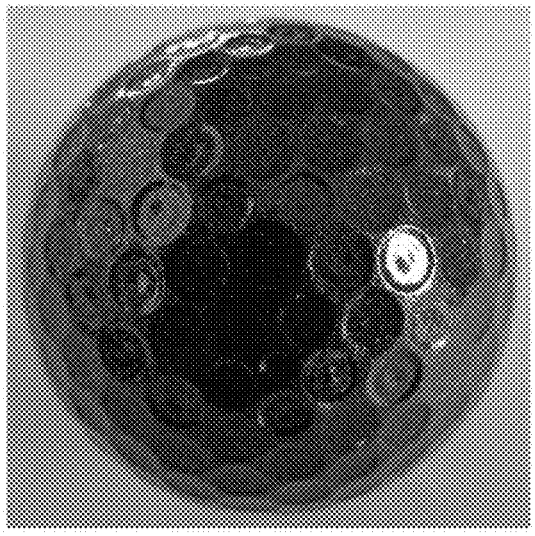
FIG. 11 is a photograph showing an appearance of one example of the golf ball according to the present invention.
Figure 12:
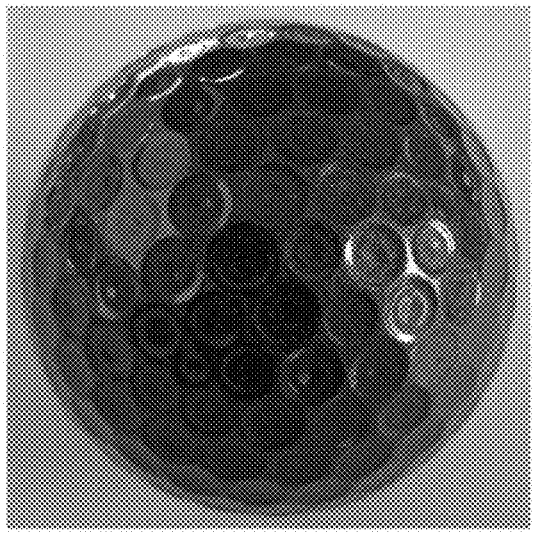
FIG. 12 is a photograph showing an appearance of one example of the golf ball according to the present invention.

| | | C5 | E7 | E8 | C6 | C7 | C8 | C9 | E9 | E10 |
|---|---|---|---|---|---|---|---|---|---|---|
| Values in Lab color system before coating | $L_0$ | 89.06 | 19.29 | 19.29 | 59.46 | 90.89 | 19.29 | 38.03 | 24.8 | 24.8 |
| | $a_0$ | −0.47 | 0.12 | 0.12 | 56.44 | −18.73 | 0.12 | −0.21 | −0.46 | −0.46 |
| | $b_0$ | −11.87 | −0.6 | −0.6 | 29.89 | 53.74 | −0.6 | −51.15 | 0.26 | 0.26 |
| | Color (with naked eye) | White | Black | Black | Orange | Yellow | Black | Blue | Grey | Grey |
| Ratio in the coating layer | Resin | 35 | 35 | 35 | 35 | 35 | 35 | 35 | 35 | 35 |
| | Bright material | 6 | 6 | 6 | 6 | 6 | 0 | 0 | 6 | 6 |
| Bright material | Kind | Pyrisma T40-24 | | Xirallic NXT M260-30 SW | Iriodin 7205 | | — | — | Iriodin 7215 | Xirallic NXT T260-23 SW |
| | Color | Green | | Gold | Gold | | — | — | Red | Blue |
| Values in Lab color system after coating | $L_1$ | 88.53 | 32.02 | 50.61 | 63.44 | 92.85 | 19.29 | 38.03 | 32.97 | 35.92 |
| | $a_1$ | 0.09 | −8.24 | −6.58 | 53.23 | −19.37 | 0.12 | −0.21 | 8.14 | 3.15 |
| | $b_1$ | −8.46 | 1.67 | 25.36 | 30.54 | 53.46 | −0.6 | −51.15 | −2.54 | −32.42 |
| $L_1 - L_0$ (ΔL) | | −0.53 | 12.73 | 31.32 | 3.98 | 1.96 | 0 | 0 | 8.17 | 11.12 |
| Luxurious appearance | | Poor | Very good | Very good | Poor | Poor | Good | Good | Very good | Very good |
| Visibility | | Very good | Good | Good | Very good | Very good | Bad | Poor | Good | Good |
| Photograph | | FIG. 7A | FIG. 7B | FIG. 8A | FIG. 8B | FIG. 8C | FIG. 9 | FIG. 10 | FIG. 11 | FIG. 12 |

In Comparative Examples 1 to 5 (i.e., C1 to C5 in tables 1 and 2), the white cover of the golf ball having an $L_0$ value of approximately 90 was covered with the coating layer in which the bright material was dispersed. As illustrated in Tables 1 and 2 and FIGS. 3 to 12, the result of Comparative Examples 1 to 5 showed that the $L_1$ value is substantially the same as the $L_0$ value and that the golf ball substantially looked pearl white, although it slightly provided a color tone of each bright material. On the other hand, in Examples 1 to Example 9 (i.e., C9 in table 2), a blue cover having an $L_0$ value of approximately 40 was covered with the coating layer containing no bright material therein. The golf ball did not provide sufficient visibility since it only showed a blue color.

In Comparative Example 6 (i.e., C6 in table 2), an orange cover having an $L_0$ value of approximately 60 was covered with a coating layer in which gold bright material was dispersed. In Comparative Example 7 (i.e., C7 in table 2), a yellow cover having an $L_0$ value of approximately 90 was covered with the coating layer in which gold bright material was dispersed. The golf ball in these Examples had an excellent visibility, but lacked the luxurious appearance since the golf ball provided a shiny pearl tone in orange or yellow. On the other hand, in Example 8 (i.e., E8 in table 2), a black cover having an $L_0$ value of 20 or less was covered with the coating layer in which gold bright material was dispersed. The golf ball exhibited a sufficient luxurious appearance due to the harmony of black and gold and without any problems of visibility.

In Examples 9 and 10 (i.e., E9 and E10 in table 2), grey covers having an $L_0$ value of 25 or less were respectively covered with coating layers in which red and blue bright materials are respectively dispersed. The golf balls in these Examples respectively exhibited the same luxurious appearance and visibility as in Examples 6 and 3 in which black covers were respectively covered with the coating layers in which the same bright materials are respectively dispersed.

What is claimed is:

1. A colored golf ball comprising:

a core;

a cover placed around the core, the cover having dimples formed on its surface; and a coating layer placed on top of the cover, a bright material being dispersed in the coating layer, wherein an $L_0$ value, which represents an L value in a Lab color system of the colored golf ball before being covered with the coating layer, is 25 or less, and the difference $\Delta L$ between the $L_0$ value and an $L_1$ value, which represents an L value in the Lab color system of the colored golf ball after being covered with the coating layer, is 5 or more.

2. The colored golf ball according to claim 1, wherein the cover contains a colorant such that the $L_0$ value, which represents the L value in the Lab color system of the colored golf ball before being covered with the coating layer, is 25 or less.

3. The colored golf ball according to claim 1, wherein the $L_1$ value, which represents the L value in the Lab color system of the colored golf ball after being covered with the coating layer, is 20 or more.

4. The colored golf ball according to claim 1, wherein the coating layer includes a colorless and transparent polymer matrix in which the bright material is dispersed.

* * * * *